US008146554B2

(12) United States Patent
Gruber

(10) Patent No.: US 8,146,554 B2
(45) Date of Patent: Apr. 3, 2012

(54) LASER IGNITION APPARATUS

(75) Inventor: Friedrich Gruber, Hippach (AT)

(73) Assignee: GE Jenbacher GmbH & Co OHG, Jenbach (AT)

( * ) Notice: Subject to any disclaimer, the term of this patent is extended or adjusted under 35 U.S.C. 154(b) by 569 days.

(21) Appl. No.: 12/314,742

(22) Filed: Dec. 16, 2008

(65) Prior Publication Data

US 2009/0158952 A1 Jun. 25, 2009

(30) Foreign Application Priority Data

Dec. 20, 2007 (AT) ..... A 2075/2007

(51) Int. Cl.
*F02P 23/04* (2006.01)

(52) U.S. Cl. ..... 123/143 B

(58) Field of Classification Search ..... 123/143 B
See application file for complete search history.

(56) References Cited

U.S. PATENT DOCUMENTS

| | | | | |
|---|---|---|---|---|
| 5,756,924 | A | 5/1998 | Early | |
| 5,876,195 | A | 3/1999 | Early | |
| 6,229,940 | B1 | 5/2001 | Rice et al. | |
| 6,382,957 | B1 * | 5/2002 | Early et al. | 431/1 |
| 6,428,307 | B1 * | 8/2002 | Early et al. | 431/1 |
| 6,514,069 | B1 * | 2/2003 | Early et al. | 431/1 |
| 6,676,402 | B1 * | 1/2004 | Early et al. | 431/1 |
| 7,436,588 | B2 * | 10/2008 | Rothenberg et al. | 359/349 |
| 7,671,295 | B2 * | 3/2010 | Sun et al. | 219/121.6 |
| 2011/0023807 | A1 * | 2/2011 | Weinrotter et al. | 123/143 B |

FOREIGN PATENT DOCUMENTS

| | | |
|---|---|---|
| JP | 2006-063829 | 3/2006 |
| JP | 2006-242034 | 9/2006 |
| JP | 2007-309129 | 11/2007 |
| JP | 2008-258446 | 10/2008 |
| WO | 97/45678 | 12/1997 |
| WO | 2006/125685 | 11/2006 |

OTHER PUBLICATIONS

European Search Report issued Apr. 14, 2009 in the corresponding European application.
Austrian Patent Office Search Report issued Dec. 20, 2007 in corresponding Austrian Patent Application No. A 2075/2007.

* cited by examiner

*Primary Examiner* — Erick Solis
(74) *Attorney, Agent, or Firm* — Wenderoth, Lind & Ponack, L.L.P.

(57) ABSTRACT

A laser ignition apparatus including at least two laser light generating devices and a common optical coupling-in means for coupling laser light from the at least two laser light generating devices into a combustion chamber of a combustion machine, wherein the at least two laser light generating devices are so arranged that laser light given off by the laser light generating devices in the operating condition impinges on the optical coupling-in means and/or issues from the optical coupling-in means in parallel displaced relationship or at an angle to each other. A method of igniting a fuel/air mixture in a combustion chamber of a combustion machine.

11 Claims, 3 Drawing Sheets

LASER IGNITION APPARATUS

The invention concerns a laser ignition apparatus including at least two laser light generating devices and a common optical coupling-in means for coupling laser light from the at least two laser light generating devices into a combustion chamber of a combustion machine. The invention further concerns a method of igniting a fuel/air mixture in a combustion chamber of a combustion machine, wherein laser light is introduced into the combustion chamber by way of a common optical coupling-in means.

A laser ignition apparatus comprising at least two laser light generating devices and a common optical coupling-in means for coupling laser light from the at least two laser light generating devices into a combustion chamber of a combustion machine, wherein the optical coupling-in means has an entrance surface for laser light from the laser light generating devices and an exit surface for the laser light.

Laser ignition is an ignition concept for internal combustion engines which are operated on the principle of the Otto cycle, the principle thereof being based on the fact that an intensive laser pulse is coupled into the combustion chamber of a combustion machine and there focussed on a focal point. At that focal point the intensity of the radiation exceeds a threshold value which is sufficient for ionisation of the fuel-air mixture and consequently for ignition of a plasma spark. That plasma spark, in a similar manner to the spark of a conventional electrical spark ignition system, is capable of igniting a fuel-air mixture.

For the engine application, the laser ignition concepts which are most intensively pursued at the present time are of such a nature that the laser pulse is produced by a solid state laser which, together with the optical coupling-in and coupling-out means, is integrated in a housing fixed to the cylinder head. That unit, by analogy with the conventional electrical spark ignition, is referred to as the laser spark plug. The ignition laser is optically pumped by a semiconductor laser connected to the laser spark plug by an optical fiber. The pumping operation during which excitation of the laser-active atoms in the solid state crystal of the ignition laser is effected until starting and discharge of the laser pulse lasts for between about 200 μs and 300 μs. The ignition pulse itself is of a duration of a few nanoseconds.

The optical coupling-in means for coupling the laser pulse into the combustion chamber of the engine comprises a suitable lens system as well as what is referred to as the combustion chamber window representing the last optical element before beam entry into the combustion chamber.

The advantage of laser ignition over conventional electrical spark ignition is inter alia that the ignition sparks can be placed freely into the depth of the combustion chamber where optimum ignition conditions prevail. In contrast thereto combustion initiation with electrical spark ignition occurs in the immediate proximity of the combustion chamber wall, wherein the flat electrodes delimiting the ignition spark impede formation of the flame core.

The energy of the laser spark can be considerably increased by increasing the power output of the laser system without increased wear resulting therefrom, as occurs for example in the case of spark ignition with electrode wear.

A further advantage of laser ignition is that, with increasing engine power output, the minimum pump energy required for plasma ignition (MPE) decreases. In comparison the conventional electrical spark ignition concepts, with the demands of modern high-output engines, already reach their system limits today.

The operational efficiency of the laser ignition system can be considerably increased in relation to an engine application in particular by more than just one plasma spark being used for igniting the mixture in the combustion chamber of the engine.

Laser concepts are known for that purpose, which divide the beam of an ignition laser by optical devices into a plurality of beam portions which, by way of the common optical focusing means, then each produce their own respective plasma spark. The disadvantages of those concepts are that the energy of an ignition laser is divided up to a plurality of plasma sparks and the respective sparks are thus markedly attenuated, but an increase in power output of the ignition laser by a multiple is difficult. A further disadvantage is that the plasma sparks are not independent of each other but occur at the same time and in coupled relationship and the engine optimisation parameters are thus reduced.

A laser ignition apparatus of the general kind set forth is known for example from U.S. Pat. No. 5,756,924. In the laser ignition apparatus shown therein laser light is directed by two different laser light generating devices on to a common optical coupling-in means which then focuses the light into the combustion chamber in order there to ignite a fuel-air mixture. For that purpose, U.S. Pat. No. 5,756,924 proposes directing the light on to the optical coupling-in means in coaxial relationship. The advantage of a common optical coupling-in means lies not only in lower costs in order to have to use only one single optical coupling-in means, but also in the fact that more laser light power can be generated specifically at given locations, than would be possible by means of a single laser light generating device.

It is found that a disadvantage with the last-mentioned state of the art is the fact that the optical coupling-in means increases severely in temperature in operation by virtue of the high levels of laser power.

The object of the present invention is therefore that of providing a laser ignition apparatus of the kind set forth in the opening part of this specification, in which the disadvantages of the state of the art are reduced.

That object is attained by a laser ignition apparatus having the features of the independent claims.

Therefore on the one hand there is provided a laser ignition apparatus including at least two laser light generating devices and a common optical coupling-in means for coupling laser light from the at least two laser light generating devices into a combustion chamber of a combustion machine, wherein the at least two laser light generating devices are so arranged that laser light given off by the laser light generating devices in the operating condition impinges on the optical coupling-in means and/or issues from the optical coupling-in means in parallel displaced relationship or at an angle different from 0° to each other.

On the other hand there is provided a method of igniting a fuel/air mixture in a combustion chamber of a combustion machine, wherein laser light is introduced into the combustion chamber by way of a common optical coupling-in means, wherein the laser light impinges on the optical coupling-in means and/or issues from the optical coupling-in means in parallel displaced relationship or at an angle to each other.

Insofar as laser light from the laser light generating devices no longer impinges on the optical coupling-in means or issues from the optical coupling-in means or both together, in axis-parallel relationship as in the state of the art, but in parallel displaced relationship with each other or at an angle with each other, the optical coupling-in means increases in temperature, the complete laser light power of both laser light generating devices is never focused only on a single surface which occurs with coaxial laser light beams, but the laser light power is distributed on to larger regions of the optical coupling-in means. The entrance surfaces for the laser light at the optical coupling-in means and/or the exit surfaces of the laser light at the optical coupling-in means are therefore at least region-wise separate from each other, whereby the loading and stressing on the optical coupling-in means due to the laser light at the entrance surfaces or exit surfaces is less.

In the simplest case the optical coupling-in means is a convergent lens or a system comprising a plurality of lens which converge or focus the laser light into the combustion chamber of a combustion machine. It can be provided that the laser light generating devices are so arranged that the entrance surfaces at the optical coupling-in means for the laser light are separate from each other at the common optical coupling-in means. In the simplest case that is achieved by a non-coaxial arrangement of the laser light beams of the at least two laser light generating devices. It can also be provided that the laser light generating devices are so arranged that the exit surfaces at the optical coupling-in means for the laser light are separate from each other at the common optical coupling-in means.

Two concepts in terms of structural variants have proven to be particularly advantageous in accordance with the invention. In the first concept in accordance with a variant it is provided that the at least two laser light generating devices are so arranged that the exit surface of the laser light of the first laser light generating device and the exit surface of the laser light of the second laser light generating device are substantially parallel or in one plane. In other words in this case laser light which is produced in the operating condition is in parallel displaced relationship. In that variant therefore two laser light beams are focused in substantially mutually parallel relationship on to a common optical coupling-in means which then focuses the laser light jointly for example on to a single focal point. That has proven to be advantageous in particular in relation to ignition concepts where either a particularly high level of power is required at a focal point for a single ignition moment or where laser light pulses are to be focused on a single focal point in time-staggered relationship.

That first concept is found to be advantageous for example when the time required for pumping a single laser light generating device so that it can output an ignition pulse lasts longer than a working cycle of the combustion machine. In that case the second laser light generating device can be provided to cause the ignition process alternately in relation to the first laser light generating device. Other variants provide that laser pulses are introduced into the combustion chamber in time-staggered relationship in order to ignite the fuel-air mixture over a longer period of time or to achieve a kind of pre-ignition. The pulse durations and the pulse time spacings are dependent on the selected fuel-air mixture.

For the second concept it can be provided in a second variant that the at least two laser light generating devices are so arranged that the exit surfaces of the laser light of the first laser light generating device and the exit surface of the laser light of the second laser light generating device are arranged at an angle different from 0°. In this variant laser light which is outputted in the operating condition generally impinges on the optical coupling-in means at an angle relative to each other or issues from the optical coupling-in means at an angle relative to each other.

In this case the two laser light generating devices can be arranged at a given angle relative to each other which is preferably between 175° and 100°, preferably between 170° and 135°. In that way for example spatially separate ignition sparks or focal points can be produced with a simple convergent lens, which is found to be advantageous in the case of many ignition concepts in order to produce ignition over a larger surface area for the fuel-air mixture. In contrast to ignition concepts in which a laser beam is distributed to two focal points whereby ignition occurs at the same time at the two focal points, ignition sequences which are staggered in respect of time are possible in the present case. In that respect it is particularly preferably provided that there are at least three laser light generating devices, particularly preferably four laser light generating devices, which are so arranged relative to each other that in the operating condition four focal points arranged at a spacing relative to each other can be produced. They could be arranged for example at the corners of a preferably equilateral triangle or a square, rectangle, rhombus etc.

In a preferred variant (in particular in accordance with the second concept) it can further be provided that at least one laser light deflection element is disposed between the laser light generating device and the optical coupling-in means. Laser light deflection elements make it possible for the laser light of the respective laser light generating devices to be arranged at a different (for example steeper) angle relative to each other in order then to suitably deflect the laser light on to the optical coupling-in means by way of the laser light deflection elements. In that way the laser light beam guidance can be even better influenced than is possible by the optical coupling-in means alone and it is possible to produce a plurality of focal points, at a smaller spacing or a larger spacing relative to each other.

In that respect it can be provided that the light deflection elements are in the form of mirrors so that laser light can be deflected by way of reflection on to the optical coupling-in means.

To be able to produce a laser ignition pulse which is staggered in respect of time, it can be desirably provided that the laser light generating devices are optically pumpable separately from each other. For cost reasons it can be provided that the laser light generating devices have a common pump light source.

In a particularly preferred variant it can be provided that the laser ignition apparatus is in the form of a—preferably one-piece—laser spark plug as that ensures particularly compact structure.

The advantage of the specified apparatus or method, besides the reasons already referred to hereinbefore, is also that two laser light generating devices afford a redundancy which ensures a higher level of operational reliability in engine use in the event of failure of a laser light generating apparatus.

BRIEF DESCRIPTION OF THE DRAWINGS

Further details and advantages of the invention are described with reference to the Figures and the specific description. In the Figures.

DETAILED DESCRIPTION OF THE INVENTION

Figure 1:
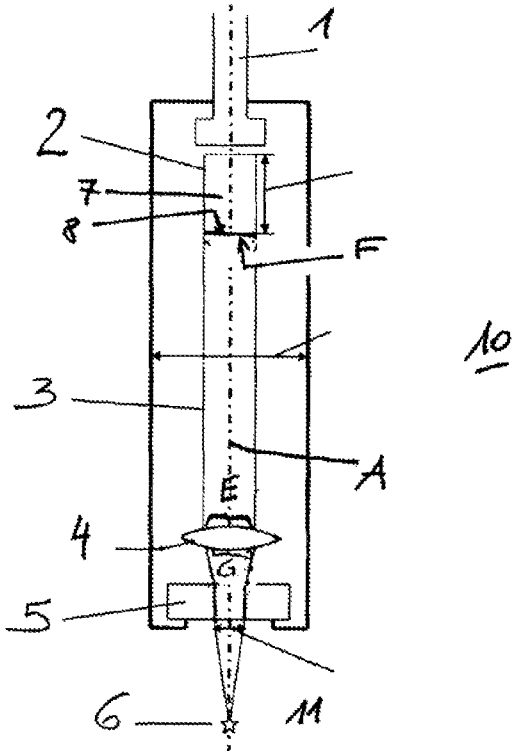
Fig. 1 PRIOR ART
FIG. 1 is a cross-sectional view of a laser ignition apparatus in the state of the art.

FIG. 1 shows a diagrammatic view of a laser ignition apparatus 10 in accordance with the state of the art. The laser ignition apparatus 10 is in the form of a laser spark plug and includes an ignition laser monolith 2 which has a resonator 7 and a coupling-out mirror 8 so that laser light, as indicated by the beam path of the laser light 3, is directed on to the optical coupling-in means 4 which focuses the laser light 3 on to a focal point 6 at which the plasma spark is produced. The laser light exit surface is identified by F and describes the surface from which ignitable laser light issues from the laser light generating device 2 before it is directed on to the optical coupling-in means 4. The laser ignition apparatus is delimited by a combustion chamber window 5 through which the laser light 3 is fed into the combustion chamber 11 of a combustion machine 11. The ignition laser monolith 2 is fed with pump light by an optical fiber 1 connected to a pump light source (not shown). After suitable amplification of the pump light in the ignition laser monolith 2 ignitable laser light 3 is produced. In accordance with the state of the art it can further be provided that somewhere between the coupling-out mirror 8 and the optical coupling-in means 4 laser light 3 is fed in along the optical axis A of the optical coupling-in means 4 coaxially in relation to the laser light 3 of the illustrated ignition monolith 2 and impinges on the optical coupling-in means 4 in common relationship on the entrance surface E thereof. The exit surface of the laser light is identified by G.

Figure 2:
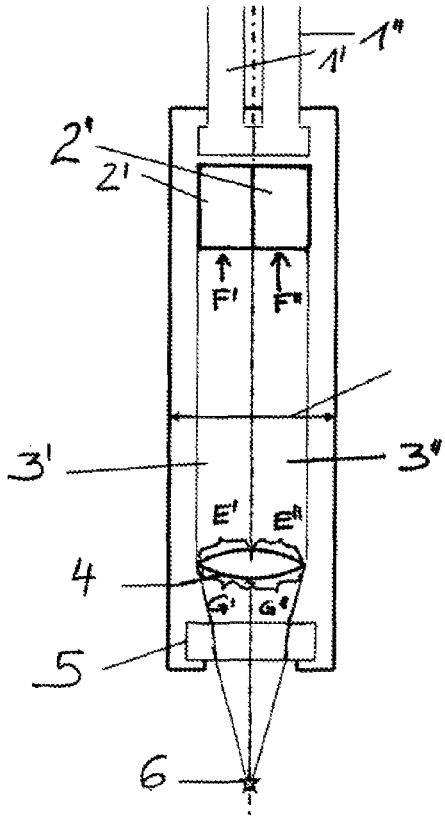
FIG. 2 shows a first variant of a laser ignition apparatus in accordance with the invention.

FIG. 2 now shows an embodiment in which laser light 3', 3" from two separate laser light generating devices 2', 2" impinges in mutually parallel displaced relationship on the common optical coupling-in means 4. The embodiment illustrated involves the variant described hereinbefore in the description as the 'first concept', wherein the exit surfaces F' and F" of the respective ignition lasers 2' and 2" respectively are arranged in a plane (parallel displacement would also be possible, the crucial point being that the beam paths of the laser light 3', 3" are parallel to each other. As the other components are identical in content to FIG. 1, identical components are no longer described in greater detail in FIG. 2 and in FIGS. 3 and 4). There are now two ignition laser monoliths 2', 2" (for the ignition laser monoliths, attention is also directed to WO 2006/125685) which output ignitable laser light 3', 3" at the laser light exit surfaces F', F". The two ignition laser monoliths 2', 2" are pumped by means of separate optical fibers 1', 1" by way of a pump light source (not shown). The beam path of the respective laser light 3' and 3" is directed on to the optical coupling-in means 4. The entrance surfaces E' and E" at the optical coupling-in means 4 are disposed in spatially mutually juxtaposed relationship and are thus completely separate from each other. The laser light is then focused by way of the optical coupling-in means 4 to the combustion space 11 of the combustion chamber of a combustion machine. The exit surfaces G', G" of the laser light 3', 3" are also spatially separate from each other. The laser light 3' of the first laser light generating device 2' and the laser light 3" of the second laser light generating device 2" issue at an angle to each other from the optical coupling-in means 4.

Figure 3:
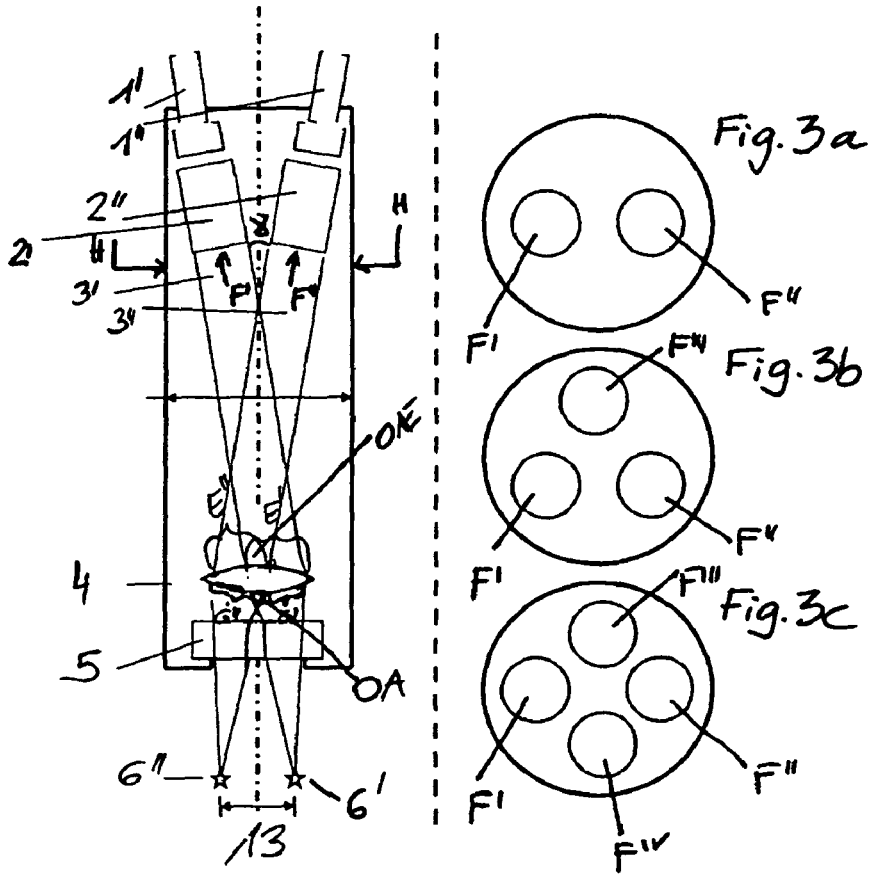
FIG. 3 shows a second variant of a laser ignition apparatus in accordance with the invention.

FIG. 3 shows a variant in accordance with the above-described variant 2. The laser light 3', 3" of the respective laser light generating devices 2', 2" impinges on the optical coupling-in means 4 at an angle α (different from 0°) relative to each other. The angle α here is about 20°. In this case the two laser light generating devices 2', 2" or the ignition laser monoliths are inclined relative to each other so that the exit surfaces F' and F" of the respective laser light generating devices are also arranged at an angle different from 0°. In the present case that angle is about 160°. The entrance surfaces E' and E" at the optical coupling-in means 4 for laser light 3', 3" from the laser light generating devices 2', 2" are in this case separated in wide regions, there is an overlap OE only in the core region. That can be tolerated without overheating occurring at that location, in particular as the exit surfaces G', G" are also substantially overlap-free except for a small core region OA. The laser light 3, 3" is distributed to two focal points 6', 6". The spacing between the focal points 6', 6" is identified by reference 13.

FIGS. 3*a* through 3*c* show variants with two (FIG. 3*a*), three (FIG. 3*b*) and four (FIG. 3*c*) laser light generating devices. The illustrations show views on to the laser light exit surfaces F', F", F"', F"' along the section H-H. In this case the laser light exit surfaces F', F", F"', F"' are arranged along a straight line (FIG. 3*a*; corresponds to the variant of FIG. 3), at the corners of an equilateral triangle (FIG. 3*b*) and at the corners of a square (FIG. 3*c*) respectively.

Figure 4:
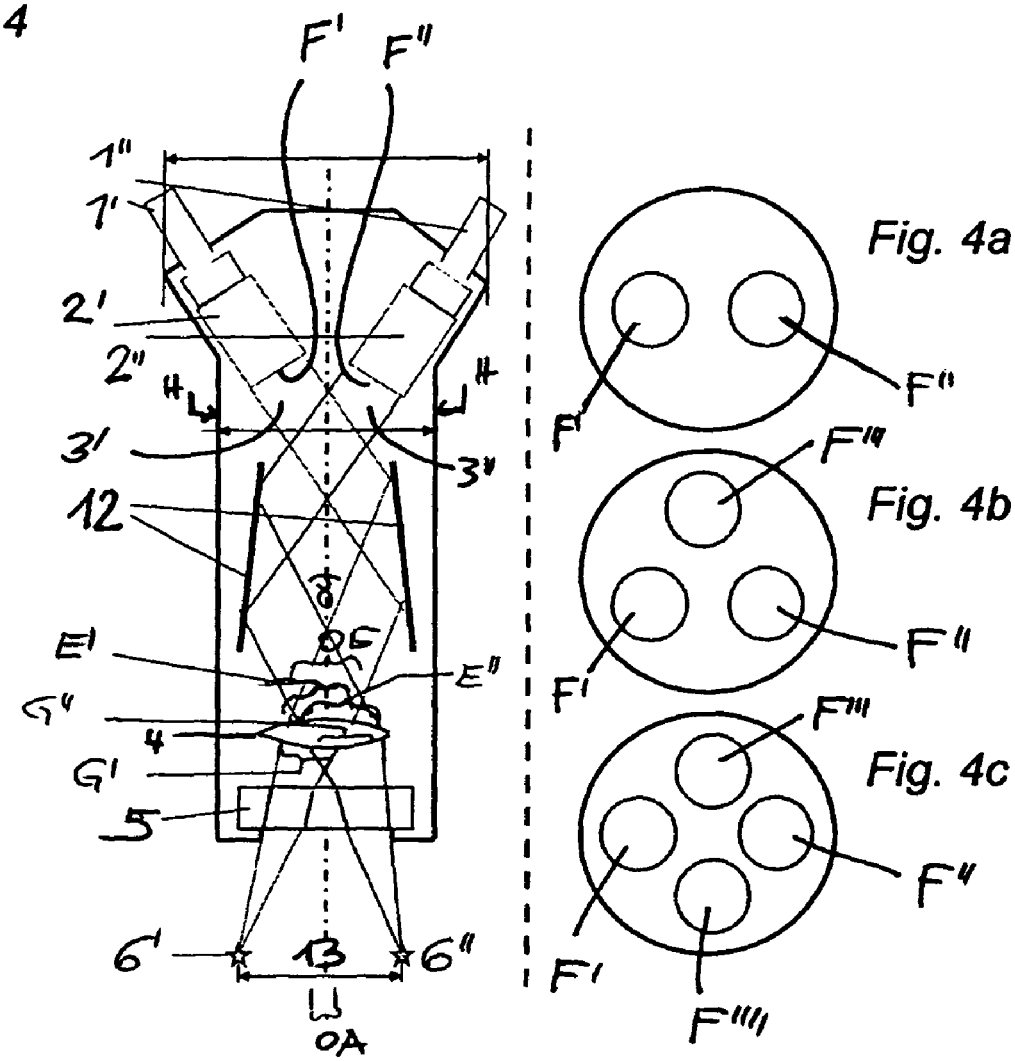
FIG. 4 shows a modification of the FIG. 3 variant.

FIG. 4, in addition to what is shown in the FIG. 3 variant, shows laser light deflection elements 12 in the form of mirrors. The angle α between the laser light beams 3', 3" is selected to be greater than in FIG. 3. The maximum angle α in the arrangement of FIG. 3 or FIG. 4 is appropriately not more than 90° to keep the arrangement compact although it will be appreciated that other angles α could also be implemented by means of additional laser light deflection elements 12. The arrangement of the laser light exit surfaces F', F" is such that the angle between those surfaces is steeper. In that way, by means of the laser light deflection elements 12, the spacing 13 between the focal points 6', 6" can be greater (than for example in comparison with FIG. 3). In this variant the entrance surfaces E' and E" at the optical coupling-in means 4 almost coincide so that there is a relatively large overlap region OE. It will be noted however that the exit surfaces G', G" are further away from each other so that the optical coupling-in means 4 is sufficiently relieved of load by virtue of that enlargement of the laser light, by virtue of a suitably small overlap area OA.

FIGS. 4*a* through 4*c*, similarly to FIGS. 3*a* through 3*c*, show arrangements of the laser light exit surfaces F', F"', F"', F"'.

The invention claimed is:

1. A laser ignition apparatus, comprising:

at least two laser light generating devices;

a common optical coupling-in means for coupling laser light from the at least two laser light generating devices into a combustion chamber of a combustion machine; and mirrors for deflecting the laser light from the at least two laser light generating devices, the mirrors being disposed between the at least two laser light generating devices and the optical coupling-in means, wherein the at least two laser light generating devices are arranged such that an exit surface of a first one of the laser light generating devices and an exit surface of a second one of the laser light generating devices are disposed at an angle different from 0° relative to each other, and wherein the at least two laser light generating devices are arranged such that the laser light given off by the at least two laser light generating devices in the operating condition impinges on the optical coupling-in means or issues from the optical coupling-in means in a parallel displaced relationship or at an angle to each other.

2. A laser ignition apparatus as set forth in claim 1, wherein the at least two laser light generating devices are arranged such that entrance surfaces at the optical coupling-in means for the laser light are separate from each other at the common optical coupling-in means.

3. A laser ignition apparatus as set forth in claim 1, wherein the at least two laser light generating devices are arranged such that exit surfaces at the optical coupling-in means for the laser light are separate from each other at the common optical coupling-in means.

4. A laser ignition apparatus as set forth in claim 1, wherein the angle formed between the exit surface of the first one of the laser light generating devices and the exit surface of the second one of the laser light generating devices is between 175° and 100° .

5. A laser ignition apparatus as set forth in claim 1, wherein the at least two laser light generating devices are optically pumpable separately from each other.

6. A laser ignition apparatus as set forth in claim 5, wherein the at least two laser light generating devices have a common pump light source.

7. A laser ignition apparatus as set forth in claim 1, wherein said laser ignition apparatus is in the form of a laser spark plug.

8. A laser ignition apparatus as set forth in claim 1, wherein the at least two laser light generating devices are arranged such that laser light given off by the at least two laser light generating devices in the operating condition impinges on the optical coupling-in means and issues from the optical coupling-in means in a parallel displaced relationship or at an angle to each other.

9. A method of igniting a fuel/air mixture in a combustion chamber of a combustion machine, said method comprising:

generating laser light with at least two laser light generating devices arranged such that an exit surface of a first one of the laser light generating devices and an exit surface of a second one of the laser light generating devices are disposed at an angle different from 0° relative to each other;

deflecting the laser light generated by the at least two laser light generating devices with mirrors disposed between the at least two laser light generating devices and a common optical coupling-in means; and introducing the deflected laser light into the combustion chamber by way of the common optical coupling-in means, wherein the laser light impinges on the optical coupling-in means or issues from the optical coupling-in means in a parallel displaced relationship or at an angle to each other.

10. A method of igniting a fuel/air mixture in a combustion chamber of a combustion machine, said method comprising:

generating laser light with at least two laser light generating devices arranged such that an exit surface of a first one of the laser light generating devices and an exit surface of a second one of the laser light generating devices are disposed at an angle different from 0° relative to each other;

deflecting the laser light generated by the at least two laser light generating devices with mirrors disposed between the at least two laser light generating devices and a common optical coupling-in means; and introducing the deflected laser light into the combustion chamber by way of the common optical coupling-in means, wherein the laser light impinges on the optical coupling-in means and issues from the optical coupling-in means in a parallel displaced relationship or at an angle to each other.

11. A laser ignition apparatus as set forth in claim 2, wherein the at least two laser light generating devices are arranged such that exit surfaces at the optical coupling-in means for the laser light are separate from each other at the common optical coupling-in means.

* * * * *